US006126347A

United States Patent [19]

Sakaino et al.

[11] Patent Number: 6,126,347

[45] Date of Patent: Oct. 3, 2000

[54] PRINTER

[75] Inventors: Tsuyoshi Sakaino, Tokyo; Tadashi Yamashita, Higashimurayama, both of Japan

[73] Assignee: Citizen Watch Co., Ltd., Tokyo, Japan

[21] Appl. No.: 09/230,508

[22] PCT Filed: Jun. 19, 1998

[86] PCT No.: PCT/JP98/02747

§ 371 Date: Jan. 26, 1999

§ 102(e) Date: Jan. 26, 1999

[87] PCT Pub. No.: WO98/58863

PCT Pub. Date: Dec. 30, 1998

[30] Foreign Application Priority Data

Jun. 20, 1997 [JP] Japan ..... 9-179117
Jul. 4, 1997 [JP] Japan ..... 9-179280

[51] Int. Cl.[7] ..... B41J 13/10

[52] U.S. Cl. ..... 400/642; 400/645

[58] Field of Search ..... 400/642, 645, 400/617, 616, 611

[56] References Cited

U.S. PATENT DOCUMENTS 5,015,109 5/1991 Brandon et al. ..... 400/642
5,478,163 12/1995 Flugge et al. ..... 400/642
6,036,383 3/2000 Lodwig et al. ..... 400/611

FOREIGN PATENT DOCUMENTS 61-282247 12/1986 Japan .
1-275082 11/1989 Japan .
5-37795 5/1993 Japan .
5-185671 7/1993 Japan .
6-247585 9/1994 Japan .

*Primary Examiner*—John S. Hilten
*Assistant Examiner*—Anthony H. Nguyen
*Attorney, Agent, or Firm*—Smith, Gambrell & Russell, LLP

[57] ABSTRACT

First and second sheet guides (21, 31) are arranged individually in front and at the back of a print head (6) in a sheet feeding direction. Each of these sheet guides (21, 31) has an arcuate end edge opposite to the print head (6), the width-direction central portion of the end edge being located at the longest distance from the print head so that the space between the end edge and the print head gradually increases with lateral distance from the width-direction central portion of the end edge. In consequence, the leading end portion of a sheet that is printed by means of the print head (6), especially its opposite ends, can be prevented from abutting against the sheet guides (21, 31) and causing jamming due to deformation of the sheet or the like as the leading end portion of the sheet passes through a gap between a conveyor plate (9) and the sheet guides (21, 31).

18 Claims, 9 Drawing Sheets

PRINTER

TECHNICAL FIELD

The present invention relates to a printer provided with a sheet guide on a sheet conveyor path along which a printing sheet is fed.

BACKGROUND ART

In a sheet guide of a conventional printer, a head facing portion that faces a print head is rectilinear. Therefore, the print head and the head facing portion of the sheet guide have a substantially uniform space across the width between them. In this case, the leading end portion of a sheet that is printed by means of a print mechanism including the print head, especially its opposite ends, tend to abut against the sheet guide and cause jamming due to deformation of the sheet or the like as the leading end portion of the sheet passes through a gap between the sheet guide and a conveyor plate.

Referring now to the plan view of FIG. 5 and the sectional view of FIG. 6, there will be described a sheet guide of a conventional printer that can print continuous and cut sheets.

A carriage shaft 53 (indicated by two-dot chain line in FIG. 5) is stretched between left- and right-hand side frames 52 of a printer 51. A carriage 55 is supported on the carriage shaft 53 for reciprocation in the axial direction of the carriage shaft 53. A print head 56 is mounted on the carriage 55 in a manner such that it can reciprocate integrally with the carriage 55.

Conveyor plates 59 are arranged in front and at the back of the print head 56. A first sheet guide 61 and a second sheet guide 71 are arranged on these conveyor plates 59, individually.

The first sheet guide 61 is formed with a head facing portion 61*a,* which faces the print head 56 and extends parallel to the carriage shaft 53. Downward from the head facing portion 61*a* extends a sheet guide face 61*b* in the form of a slope, which serves to guide a sheet 60 (indicated by two-dot chain line in FIG. 5), printed by means of a print mechanism including the print head 56, to a conveyor path 62 that is defined between the undersurface of the first sheet guide 61 and the conveyor plates 59. Further, the second sheet guide 71, like the first sheet guide 61, is formed with a head facing portion 71*a* and a sheet guide face 71.

FIG. 5 shows a state in which the right-hand side portion of the leading end edge of the sheet 60, which is slightly skewed as it is fed to the printer, abuts against the head facing portion 71*a* of the second sheet guide 71. FIG. 6 is a view taken from the section side of the sheet 60 and showing the same state. If the right-hand side portion of the leading end of the sheet 60 is warped and lifted, as shown in FIG. 6, then the sheet 60, which is advancing forward, abuts against the second sheet guide 71, so that it cannot be guided by the sheet guide face 71*b* to get under the second sheet guide 71. Inevitably, therefore, the sheet 60 causes jamming in the printer.

If the sheet guide face 71*b* is located high in this case, the sheet 60 can be led to a position under the second sheet guide 71 even though the sheet 60 is warped substantially. However, if the height of the sheet guide face 71*b* is great, then the printer will be thick-profiled, which is not a favorable factor for the reduction in size and thickness of the printer.

In some printers, moreover, it is necessary to detect the presence of a sheet (e.g., to detect the leading end of the sheet or the like) that is conveyed in either of two opposite directions, forward and reverse, on the conveyor path. Preferably, the presence of the sheet should be determined by detecting the width-direction central portion of the sheet so that the sheet can be detected in a predetermined detecting position on the conveyor path without regard to its variation in width. To attain this, a sheet detecting mechanism is provided in a given position on the conveyor path through which the width-direction central portion of the sheet passes.

Many of conventional sheet detecting mechanisms comprise an optical sensor that is composed of a light emitting element and a light receiving element in a pair. One and the other of these elements are located individually at right angles to a conveyor path on either side thereof, facing a sheet detecting position on the conveyor path. The presence of a sheet is detected as an output signal from the light receiving element is turned on or off.

In the sheet detecting mechanism having the light emitting and receiving elements arranged separately on one and the other side of the conveyor path, however, two element parts are needed for detection, and a transit substrate for the arrangement of the other element must be provided on the other side of the conveyor path. Further, a harness for signal transmission must be connected between the transit substrate on the other side of the conveyor path and the one side of the conveyor path. Therefore, the harness must be made to extend long without interfering with the conveyor path, so that wiring is troublesome, and a connector for connection is need. Thus, the manufacturing costs increase correspondingly.

There is a method, moreover, in which a sheet is detected directly by means of a transmission-type photo-interrupter as a sheet detecting sensor. Although only one element part is need for detection, in this case, the width-direction central portion of the sheet cannot be detected, since the region to be detected is a width-direction end portion of the sheet.

Also known is a printer, such as a flat-bed printer, in which a sheet can be conveyed in either of two opposite directions, forward and reverse, on a conveyor path, for example. According to this version, the direction in which a continuous sheet is conveyed is opposite to the conveying direction for a cut sheet on the same conveyor path. In many printers, furthermore, a main control board, which is provided with control means for realizing a control system for controlling various functions (e.g., sheet feed, printing, carriage transfer, etc.), is located on the base plate of the printer body, while the sheet conveyor path is situated above the base plate of the printer body. It is advisable, therefore, to provide the main control board with sensors and other elements that require wire connection with the control means.

DISCLOSURE OF THE INVENTION

The object of the present invention is to provide a printer capable of preventing a printing sheet from abutting against a sheet guide and causing jamming.

In order to achieve the above object, a printer according to the present invention comprises a cartridge slidably supported on a carriage shaft so as to be able to reciprocate along carriage shaft in a direction perpendicular to a sheet feeding direction, a print head mounted on the carriage, a platen arranged so as to oppose the print head, and a sheet guide provided on at least one of opposite sides of the print head in the sheet feeding direction. The sheet guide has an end edge which recedes in each side thereof relative to the central portion thereof, in the advancing direction of the sheet.

In the printer according to the present invention constructed in this manner, the leading end portion of the sheet that is printed by means of a print mechanism, especially its opposite ends, can be prevented from abutting against the sheet guide and causing jamming due to deformation of the sheet or the like as the leading end portion of the sheet passes through a gap between the sheet guide and a conveyor plate.

BEST MODE FOR CARRYING OUT THE INVENTION (Sheet Guide)

Figure 1:
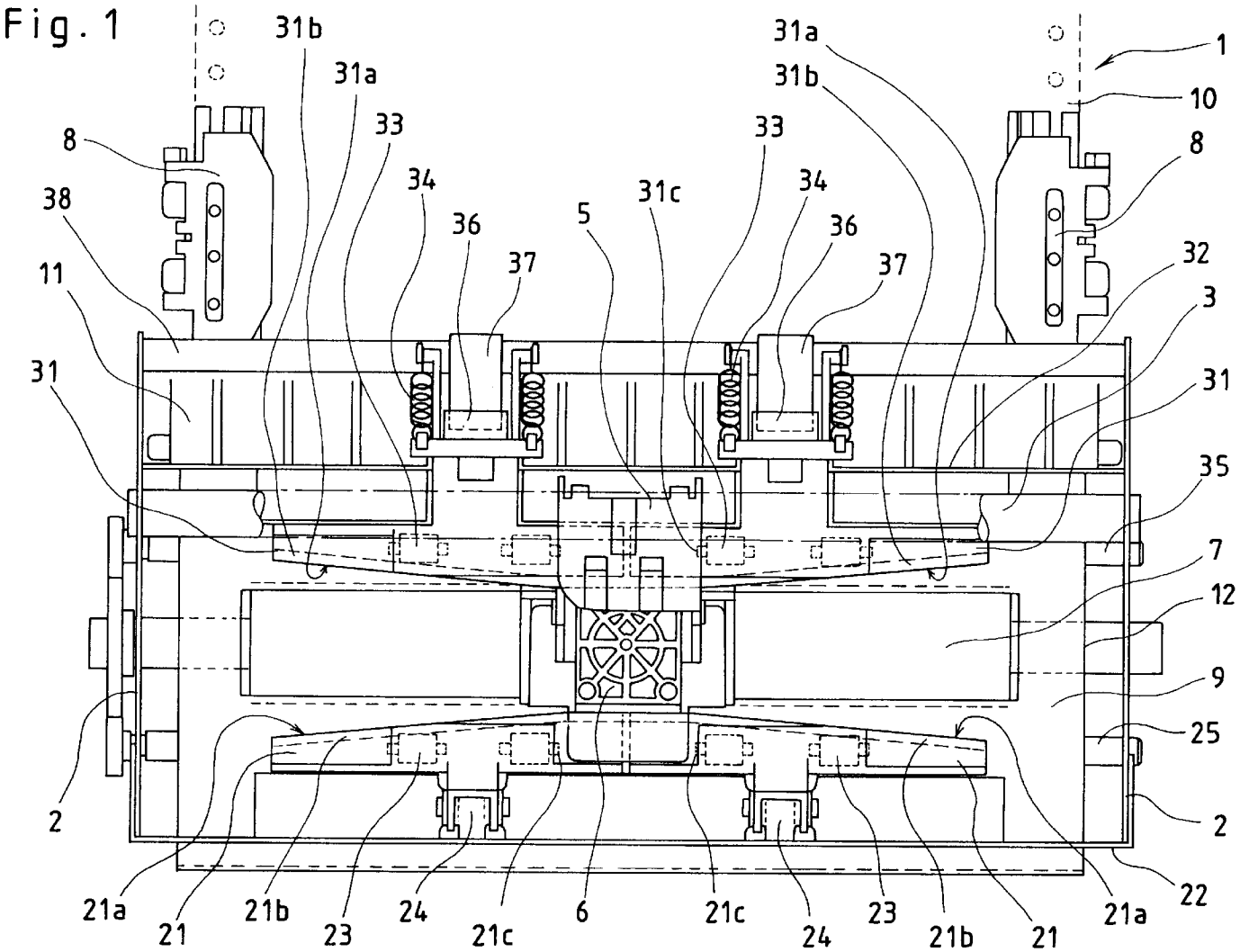
FIG. 1 is a plan view showing a principal part of one embodiment of a printer according to the present invention, having a sheet guide on a transportation path.
Figure 2:
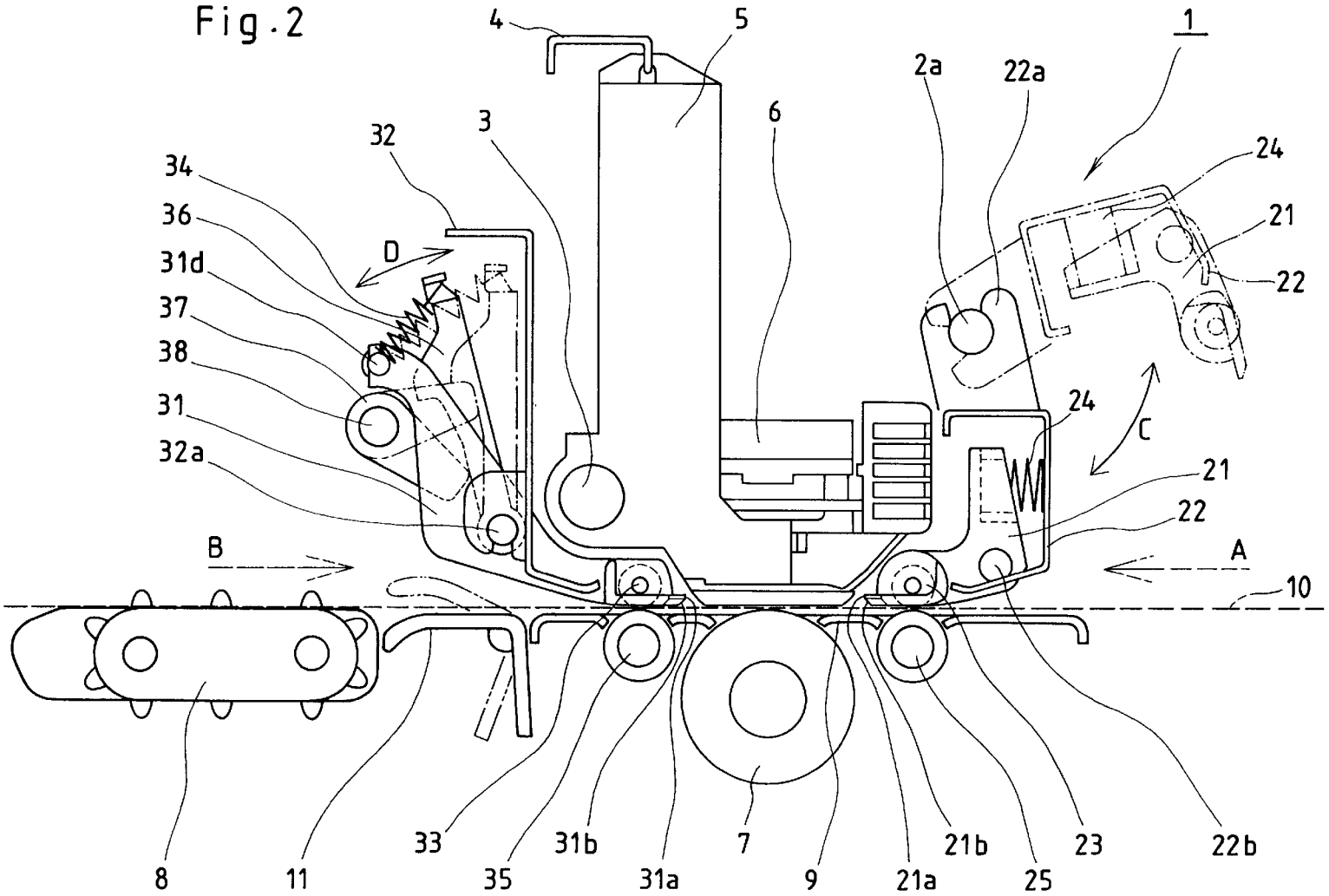
FIG. 2 is a sectional view corresponding to FIG. 1.

Referring first to FIGS. 1 and 2, there will be described an arrangement of an example of a sheet guide that is attached to a printer according to the present invention.

A carriage shaft 3 is rotatably stretched between left- and right-hand side frames 2 of a printer 1. A carriage 5 is supported by a carriage guide 4 for reciprocation in the axial direction of the carriage shaft 3. A print head 6, which is removably mounted on the carriage 5, reciprocates integrally with the carriage 5.

A platen 7 is provided under the region for the reciprocation of the print head 6. A conveyor plate 9 is located crossing the reciprocating direction of the print head 6 at right angles thereto. A sheet 10 printed by means of a print mechanism that includes the print head 6 moves on the conveyor plate 9. A first sheet guide 21 and a second sheet guide 31 are located in front and at the back of the print head 6, respectively.

The leading edge (head facing portion 21*a*) of the first sheet guide 21 that faces the print head 6 is arcuate. The trailing edge (head facing portion 31*a*) of the second sheet guide 31 that faces the print head 6 is also arcuate. As shown in the plan view of FIG. 1, the head facing portion 21*a* of the first sheet guide 21 and the head facing portion 31*a* of the second sheet guide 31 are nearest to the print head 6 at their respective transverse-direction central portions, gradually recede from the print head 6 with distance from the central portions, and are most distant from the print head 6 at their left- and right-hand ends.

Further, a sheet guide face 21*b* adjoins the head facing portion 21*a* of the first sheet guide 21, while a sheet guide face 31*b* adjoins the head facing portion 31*a* of the second sheet guide 31.

The first sheet guide 21 is divided into two parts, left and right, in the center. Each division of the first sheet guide 21 is provided with a roller pivot portion 21*c*, and a plurality of pressure-contact rollers 23 are pivotally supported on the roller pivot portion 21*c* for rotation.

As shown in FIG. 2, each side frame 2 is provided with a rocking frame pivot 2*a*, and a rocking engaging portion 22*a* of a rocking frame 22 is fitted on the rocking frame pivot 2*a*. Thus, the rocking frame 22 can rock around the rocking frame pivot 2*a*. Further, the rocking frame 22 is provided with a guide pivot portion 22*b*, and one end of the first sheet guide 21 is pivotally supported on the guide pivot portion 22*b*. Thus, the first sheet guide 21 can rock around the guide pivot portion 22*b* of the rocking frame 22, as indicated by two-dot chain line in FIG. 2.

Further, the other end of the first sheet guide 21 is provided with a spring anchor portion to which one end of a pressure-contact spring 24 is anchored. The other end of the pressure-contact spring 24 is anchored to a spring anchor portion of the rocking frame 22. This pressure-contact spring 24 urges the pressure-contact rollers 23 to be pressed against a sheet feed roller 25.

The second sheet guide 31, like the first sheet guide 21, is divided into two parts, left and right, in the center. One end portion of each division of the second sheet guide 31 is provided with a roller pivot portion 31*c*, and a plurality of pressure-contact rollers 33 are pivotally supported on the roller pivot portion 31*c* for rotation.

On the other hand, a support frame 32 having a guide pivot portion 32*a* is stretched between the side frames 2. The second sheet guide 31 is pivotally mounted on the guide pivot portion 32*a* for rotation.

The other end portion of the second sheet guide 31 is provided with a spring anchor portion 31*d* to which one end of a pressure-contact spring 34 is anchored. On the other hand, the second sheet guide 31 is provided with a pivot portion (not shown) for a rocking member 36, and the rocking member 36 is rockably supported on this pivot portion. The other end of the pressure-contact spring 34 is anchored to the distal end of the rocking member 36.

Further, switching camshaft 38 is stretched between the side frames 2 so as to be rockable with respect to the side frames 2. Switching cams 37 are fixed to the switching camshaft 38, and rocks integrally with the switching camshaft 38. A distal end portion that is formed on the distal end of the switching cam 37 abuts against an abutting portion of the rocking member 36. By rocking the switching cam 37 to change its position, the rocking member 36 can be rocked to extend or contract the pressure-contact spring 34, as indicated by two-dot chain line in FIG. 2.

Underlying the second sheet guide 31, moreover, a switching plate 11 for changing the sheet course for cut sheets or a continuous sheet and a tractor 8 for feeding the continuous sheet are arranged on a plane that contains the conveying surface of the conveyor plate 9.

Figure 3:
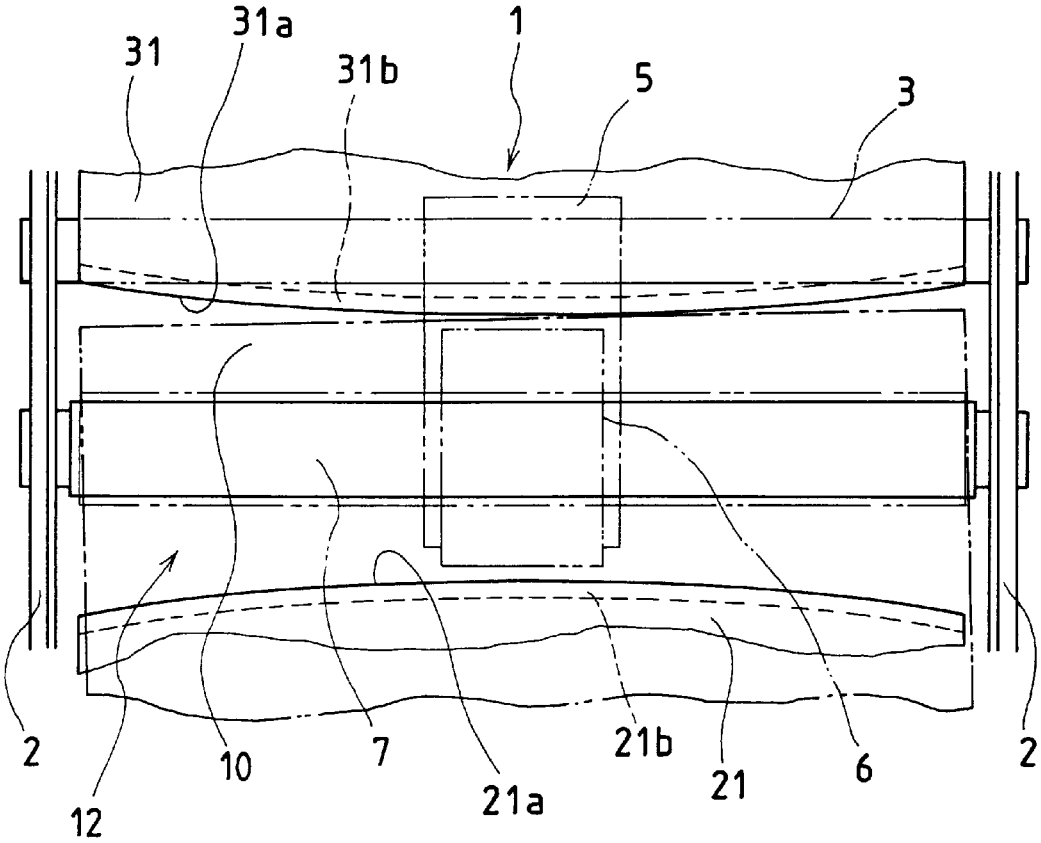
FIG. 3 is a schematic plan view for illustrating the guidance of a printing sheet by the sheet guide of FIG. 1.
Figure 4:
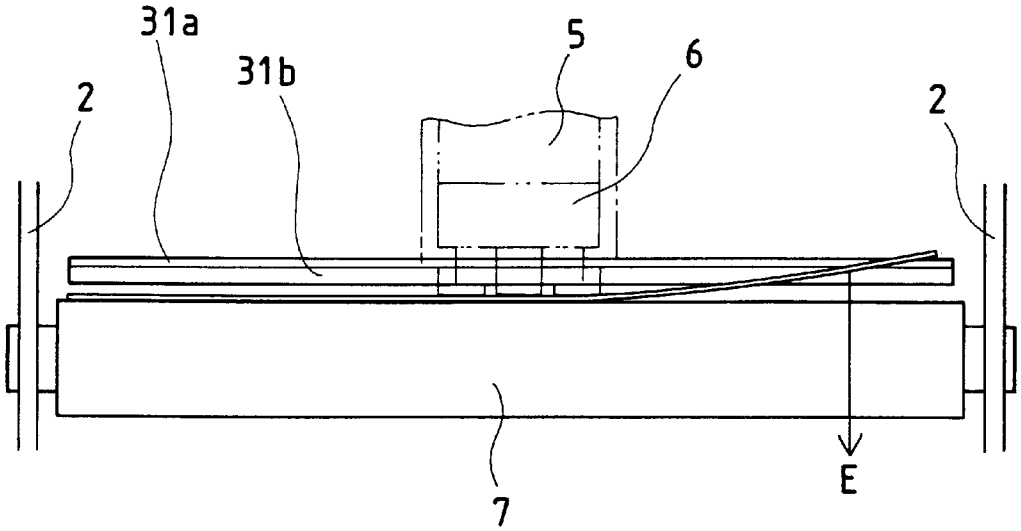
FIG. 4 is a sectional view corresponding to FIG. 3.
Figure 5:
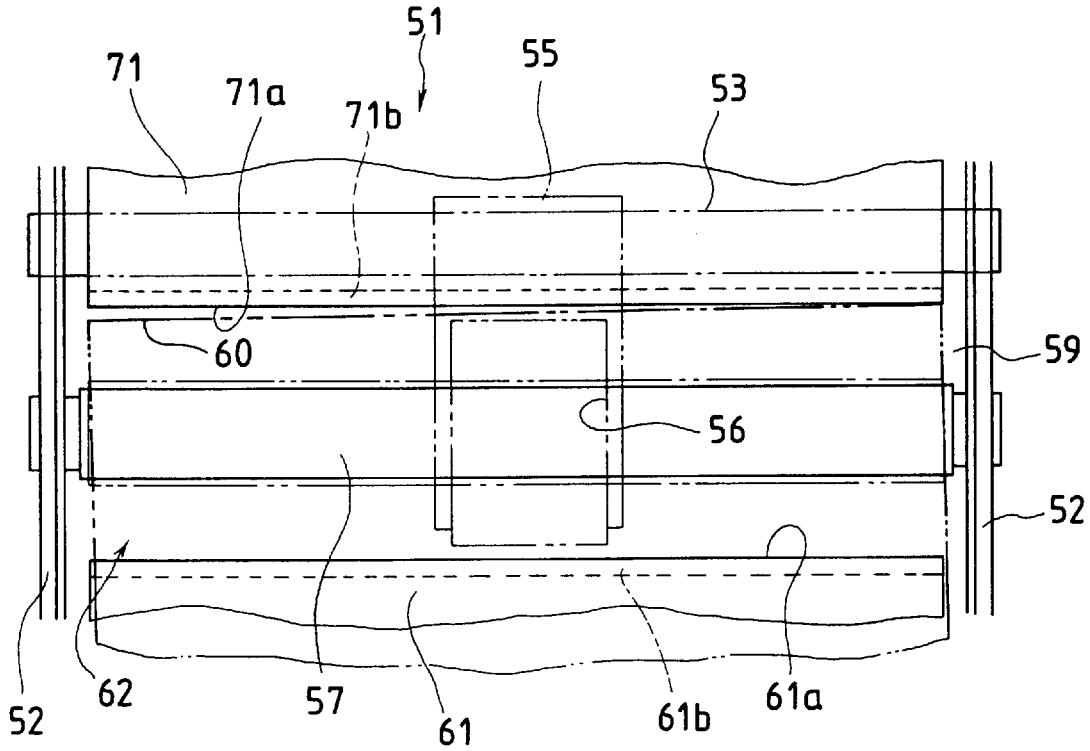
FIG. 5 is a schematic plan view for illustrating the guidance of a printing sheet by a conventional sheet guide mechanism.
Figure 6:
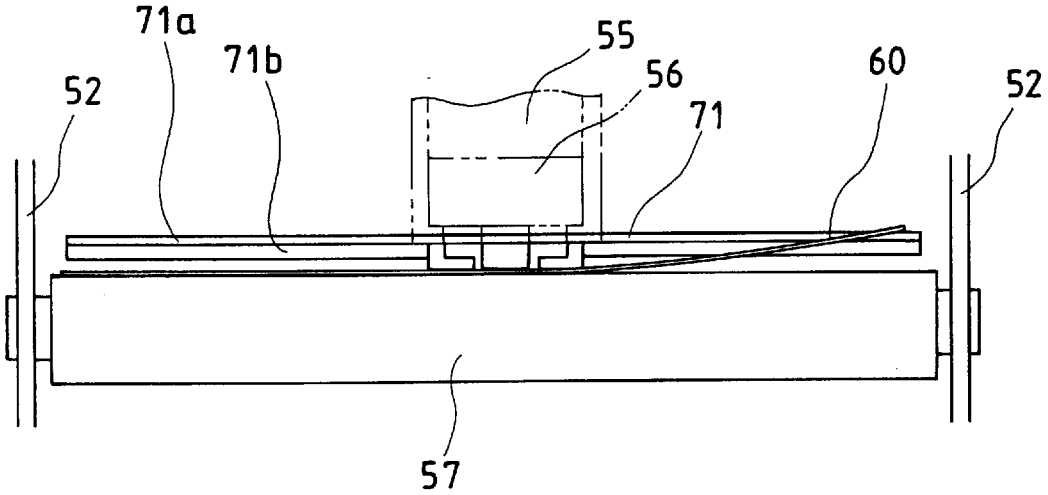
FIG. 6 is a sectional view corresponding to FIG. 5.

Referring now to FIGS. 3 and 4, there will be described an effect obtained when the sheet is fed to the sheet guide mechanism shown in FIGS. 1 and 2.

In FIGS. 3 and 4, the carriage shaft 3, carriage 5, and print head 6 are indicated by two-dot chain line. Since the sheet 10 is a cut sheet in this case, its leading end in the advancing direction is about to be guided to the undersurface of the second sheet guide 31, as shown in FIG. 3, after it passes between the first sheet guide 21 and the conveyor plate 9. The sheet 10 shown in FIG. 3 is slightly skewed. The central portion of the leading end of the sheet 10 in the advancing direction first touches the central portion of the head facing portion 31*a* of the second sheet guide 31.

In this printer 1, the carriage 5 and the print head 6 are situated in the center of the conveyor plate 9 so that the sheet 10 in the center of a conveyor path 12 is prevented from lifting by the print head 6 before the leading end of the sheet 10 reaches the undersurface of the second sheet guide 31 during the sheet feed. In consequence, the leading end of the sheet 10 is guided to the sheet guide face 31*b* of the head facing portion 31*a* of the second sheet guide 31 and then to the undersurface of the second sheet guide 31.

When its leading end is guided to the undersurface of the second sheet guide 31, the sheet 10 is gradually depressed in the direction of arrow E of FIG. 4 by the sheet guide face 31*b* that adjoins the arcuate head facing portion 31*a*. Even if the sheet 10 is warped substantially, therefore, it can be securely conveyed without jamming, since it is guided by the second sheet guide 31.

In the case described above, a cut sheet as the sheet 10 is fed to the printer 1 in a direction A of FIG. 2. In this printer 1, a bankbook may be fed in place of the cut sheet in the direction A of FIG. 2. In this case, the bankbook is guided to the undersurface of second sheet guide 31 after its register columns are printed as specified by means of the print head 6. In the case where the sheet 10 is a continuous sheet that is fed in a direction B of FIG. 2, on the other hand, the operation of the second sheet guide 31 for the cut sheet is carried out in like manner by the first sheet guide 21.

According to the printer of the present invention, as described above, a force acts to guide the leading end of the sheet securely toward the undersurface of the sheet guide as the sheet advances on the sheet conveyor path. Even if one side of the leading edge of the fed sheet is warped upward, therefore, it can be prevented from abutting against the sheet guide and causing jamming.

Further, the print head is situated in the center of the conveyor path as the sheet is fed during the time interval between the point of time immediately before the leading end of the sheet is guided to the first or second sheet guide and the time when the leading end of the sheet is guided to the first or second sheet guide for a predetermined distance. Thus, the print head holds down the central portion of the sheet, so that the leading end of the sheet can be securely guided to the undersurface of the sheet guide.

Since each of the first and second sheet guides is provided with the roller pivot portion for rotatably supporting the pressure-contact rollers that are paired with the sheet feed roller for sheet feed, the number of components can be reduced, and the space can be utilized effectively.

Since each of the first and second sheet guides is divided into a plurality of members, biased engagement of the pressure-contact rollers can be prevented, and the sheet can be securely conveyed.

(Sheet Detecting Mechanism)

Figure 7:
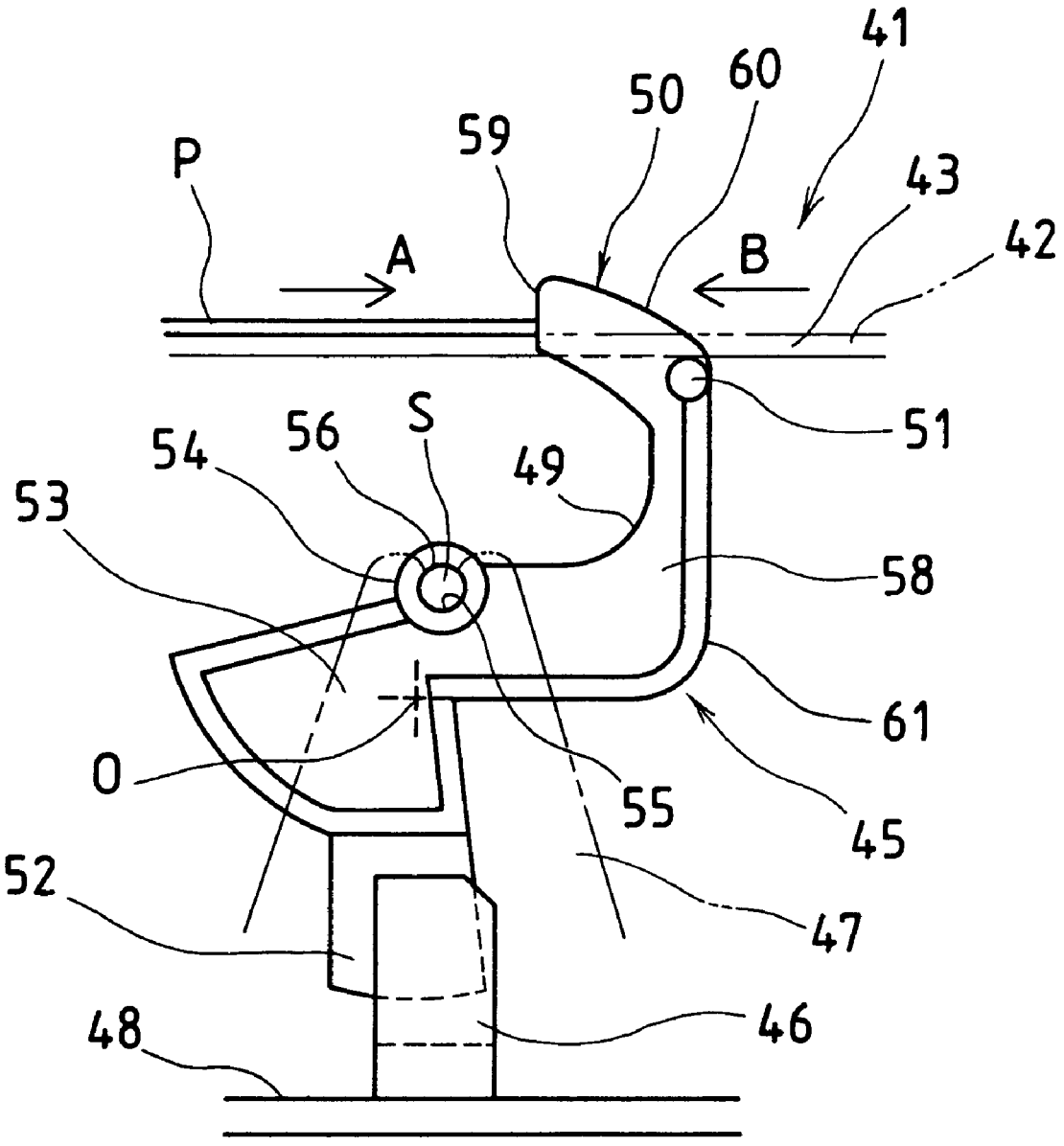
FIG. 7 is a side view showing an example of a sheet detecting mechanism provided together with the sheet guide of FIG. 1 on the sheet conveyor path of the printer, a detecting lever of the mechanism being in an initial stationary position.
Figure 8:
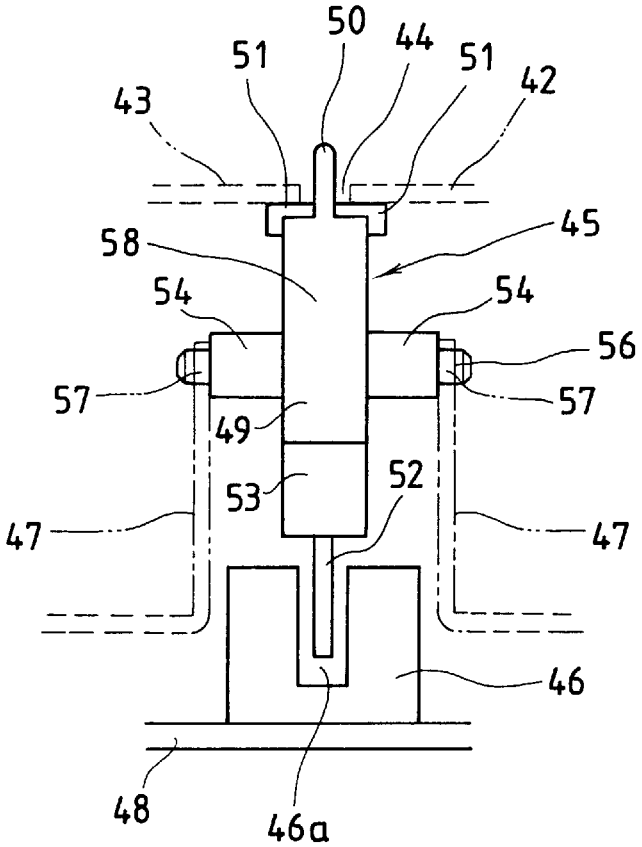
FIG. 8 is a side view of the sheet detecting mechanism of FIG. 7.

Referring now to FIGS. 7 and 8, there will be described an arrangement of an example of a sheet detecting mechanism, which is provided together with the sheet guides 21 and 31 on the conveyor path and is used to detect the presence of a sheet.

A sheet guide plate 42 (equivalent to the conveyor plate 9 of FIG. 1) is located horizontally in a printer body (not shown), and a conveyor path 43 (equivalent to the conveyor path 12 of FIG. 1) for a sheet P is formed on the top surface of sheet guide plate 42. Further, a base (not shown) of the printer body is provided under the sheet guide plate 42. The sheet P can be conveyed in either of directions A and B of FIG. 7. In FIG. 7, the direction A is the forward direction in which the sheet P is conveyed rearward from the front side of the printer, while the direction B is the reverse direction in which the sheet P is conveyed forward from the rear side of the printer. The sheet P may be a continuous sheet, cut sheet, or a set of a plurality of superposed sheets.

A sheet detecting mechanism 41 is located under the conveyor path 43. In a predetermined sheet detecting position set on the conveyor path 43, the sheet detecting mechanism 41 determines the presence of the sheet P by detecting the width-direction central portion of the sheet P. As shown in FIG. 8, a window hole 44, which is elongated in the conveying direction for the sheet P, is formed in that portion of the sheet guide plate 42 which corresponds to the sheet detecting position.

The sheet detecting mechanism 41 is composed of a detecting lever 45 and a sheet detecting sensor 46. The detecting lever 45 is rockably supported on a pivot 56, which is stretched between the respective upper ends of a pair of parallel support lugs 47, 47 that rise from the base of the printer body in the conveying direction for the sheet P. On the other hand, the sheet detecting sensor 46 is composed of a transmission-type photo-interrupter, which is located under the detecting lever 45 and set on a main control board 48 of the printer. The main control board 48 is provided with control means for realizing a control system for controlling various functions (e.g., sheet feed, printing, carriage transfer, etc.) of the printer.

A body 49 of the detecting lever 45 is in the form of a plate. The intermediate portion of the lever body 49 is rockably supported on a pivot 56. An abutting portion 50, which can engage the sheet P, is provided on the upper end portion of the lever body 49. The upper portion of the lever body 49 is provided with stoppers 51, which abut against the undersurface of the conveyor path 43 (i.e., undersurface of the sheet guide plate 42), thereby restricting the rotational position of the detecting lever 45 to its initial position. A lug-shaped sensor portion 52, which can run into a groove 46*a* of the sheet detecting sensor 46, is formed on the lower end portion of the lever body 49. Further, a weight portion 53 is provided ranging from the intermediate portion of the lever body 49 to the lower portion. It urges the detecting lever 45 in a rotating direction (counterclockwise direction in FIG. 7) such that the detecting lever 45 takes its initial position.

The weight portion 53 urges the detecting lever 45 in the rotating direction (counterclockwise direction) to return it to the initial position of FIG. 7, and causes the stoppers 51 to abut against the undersurface of the conveyor path 43, thereby keeping the detecting lever 45 stationary in the initial position. When the detecting lever 45 is in the initial position, the abutting portion 50 of the detecting lever 45 projects above the conveyor path 43 for the sheet P through the window hole 44 in the sheet guide plate 42.

As shown in FIG. 8, cylindrical projections 54, 54 individually protrude sideways from the upper part of the interpretation portion of the lever body 49. These cylindrical projections 54, 54 are formed with an axial hole 55 that penetrates the lever body 49. A pivot 56 is passed through the axial hole 55, and the opposite end portions of the pivot 56 are supported individually by recessed shaft support portions 57, 57 that are formed in the respective upper end edges of the support lugs 47, 47. In consequence, the detecting lever 45 can rock around pivot 56.

As shown in FIG. 7, a part of the lever body 49, which is situated behind its intermediate portion, is composed of a wide portion extending rearward (in the direction A in FIG. 7) from the intermediate portion, a narrow arm portion 58 extending upward from the rear end of the wide portion, and an abutting portion 50 extending forward (in the direction B in FIG. 7) from the upper end of the arm portion 58.

From the upper end of the arm portion 58, as shown in FIG. 8, protrude the pillar-shaped stoppers 51 that extend in the axial direction of the pivot 56. These stoppers 51 abut against the undersurface of the sheet guide plate 42 so that the rotational position of the detecting lever 45 is restricted to the initial position shown in FIG. 7.

Formed on the front end of the abutting portion 50, as shown in FIG. 7, is a vertical portion 59 that has an end face perpendicular to the conveying direction for the sheet P. Further, an arcuate portion 60 is formed ranging from the upper edge of the vertical portion 59 to the rear portion thereof. The arcuate portion 60 has the shape of a circular arc such that a point O for the center of the circular arc is situated below a rocking center S of the detecting lever 45 (i.e., axis of the pivot 56).

As shown in FIG. 7, on the other hand, a part of the lever body 49, which is situated ahead of its intermediate portion, forms a fan-shaped weight portion 53. A sensor portion 52 protrudes downward from the lower end of the weight portion 53. The sensor portion 52 gets into the groove 46*a* of the sheet detecting sensor 46 when the detecting lever 45 is kept at a standstill in the initial position shown in FIG. 7 by the stoppers 51.

As shown in FIG. 7, moreover, the fan-shaped peripheral edge of the weight portion 53 of the lever body 49 and the lower side edge of the arm portion 58 are formed with an edge piece 61 that projects in the axial direction of the pivot 56.

The following is a description of the operation of the sheet detecting mechanism or the way the sheet is detected by the sheet detecting mechanism.

When the detecting lever 45 shown in FIG. 7 is kept at a standstill in its initial position, the sensor portion 52 is in the groove 46*a* of the sheet detecting sensor 46, so that an output signal from the sheet detecting sensor 46 (transmission-type photo-interrupter) is off (or at low level).

Figure 9:
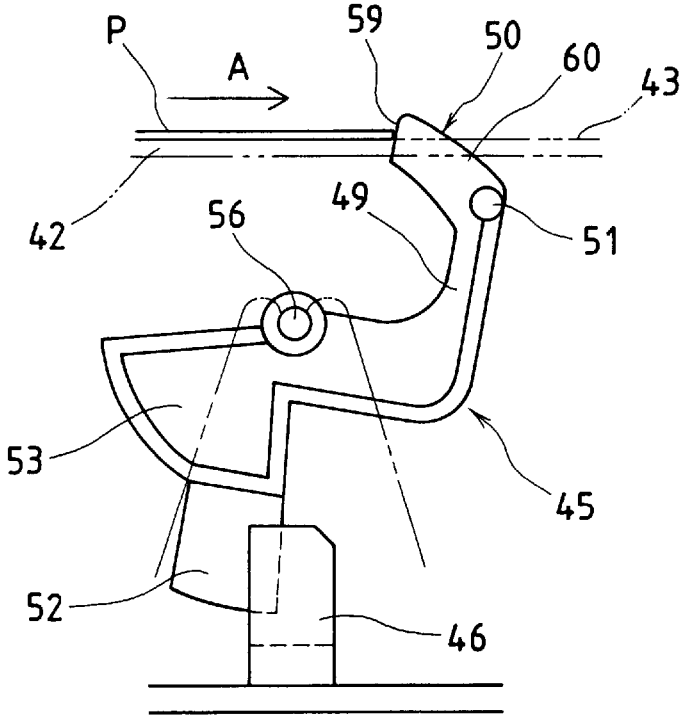
FIG. 9 is a view for illustrating the operation of the detecting lever for the case where the sheet is delivered to the sheet detecting mechanism of FIG. 7 in the forward direction.
Figure 10:
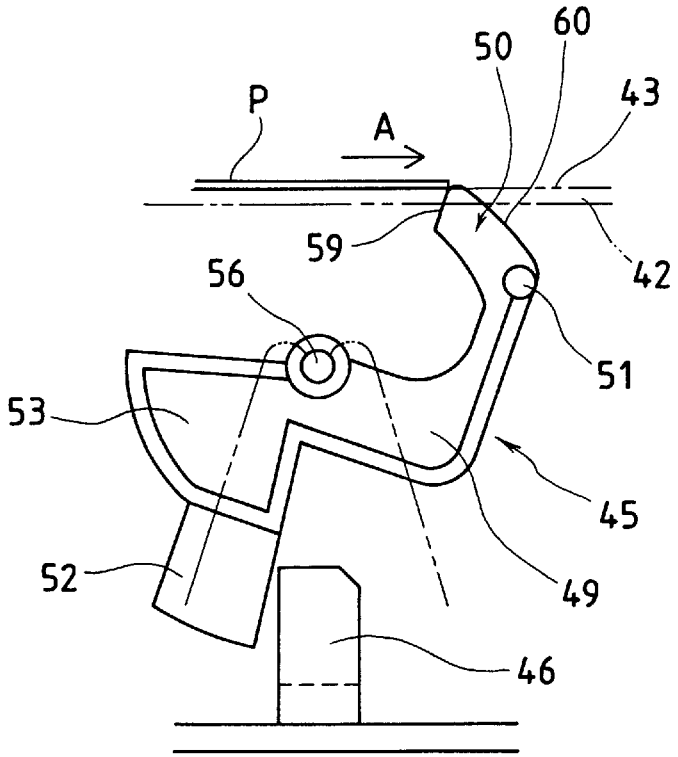
FIG. 10 is a view for illustrating the attitude of the detecting lever for the case where the sheet is delivered to the sheet detecting mechanism of FIG. 7 in the forward direction.
Figure 11:
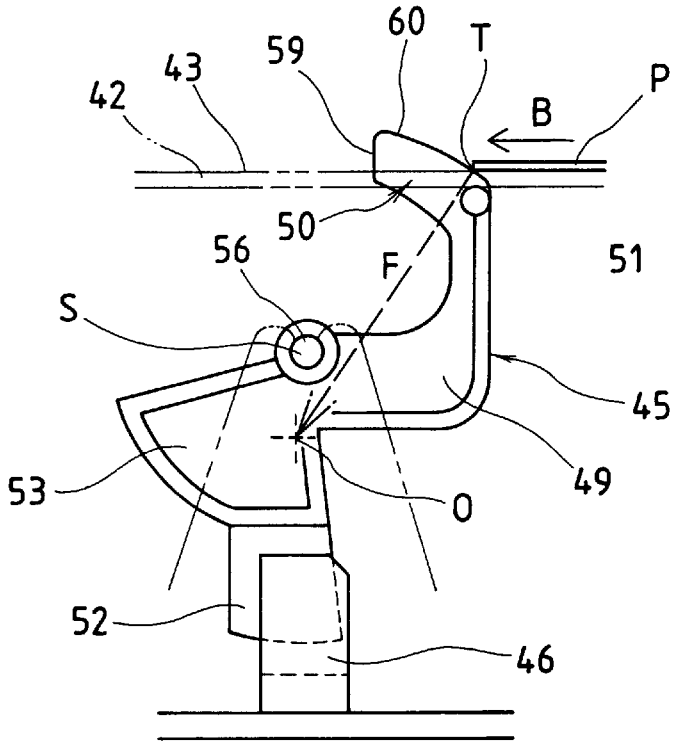
FIG. 11 is a view for illustrating the operation of the detecting lever for the case where the sheet is delivered to the sheet detecting mechanism of FIG. 7 in the reverse direction.

Referring first to FIGS. 7, 9 and 11, there will be described the way the sheet detecting mechanism operates as it detects the leading end of the sheet P that is conveyed in the forward direction.

When the leading end of the sheet P conveyed in the forward direction (direction A) abuts against the vertical portion 59 of the abutting portion 50 (see FIG. 7), the leading end of the sheet P presses the vertical portion 59 in the conveying direction (forward direction). Thereupon, this press causes the detecting lever 45 to rock around the pivot 56 in the clockwise direction of FIG. 7 or in a direction such that the stoppers 51 get away from the undersurface of the sheet guide plate 42, resisting the urging force of the weight portion 53 (see FIG. 9).

As the leading end of the sheet P continues further to push the vertical portion 59 of the abutting portion 50, the detecting lever 45 further goes on rocking clockwise, so that the abutting portion 50 moves to a position under the conveyor path 43, and the sensor portion 52 starts to get out of the groove 46*a* of the sheet detecting sensor 46. Finally, the abutting portion 50 completely submerges below the conveyor path 43, and the sensor portion 52 is entirely evacuated from the groove 46*a* of the sheet detecting sensor 46, as shown in FIG. 11. In this state, the output signal of the sheet detecting sensor 46 is on (at high level), so that it can be concluded that the leading end of the sheet P is detected by the sheet detecting sensor 46.

When no sheet on the conveyor path 43 is detected, the vertical portion 59 of the abutting portion 50 is situated in a sheet detecting position on the conveyor path 43 by the weight of the weight portion 53. If the leading end of the sheet P abuts against the vertical portion 59 when the sheet P is conveyed in the forward direction of the conveyor path 43, therefore, the detecting lever 45 can immediately rock to detect the sheet P, as shown in FIG. 11. Accordingly, the leading end position of the sheet P conveyed onto the conveyor path 43 can always be detected in a fixed position on the conveyor path 43. Thus, the leading end position of the sheet P can be accurately detected without any errors in position detection.

When the leading end of the sheet P moves in the forward direction to pass the upper end edge of the vertical portion 59 (not shown), thereafter, the detecting lever 45 is stopped in the detecting position shown in FIG. 11, since the upper end edge of the vertical portion 59 is held down by the sheet P. When the trailing end of the sheet P passes the upper end edge of the vertical portion 59, the force of pressure on the upper end edge of the vertical portion 59 is removed, so that the detecting lever 45 is urged to rock in the counterclockwise direction by the weight portion 53, and the stoppers 1 abut against the undersurface of the sheet guide plate 42 to be restrained thereby from rocking, whereupon the detecting lever 45 is kept stationary in the initial position of FIG. 7.

Figure 12:
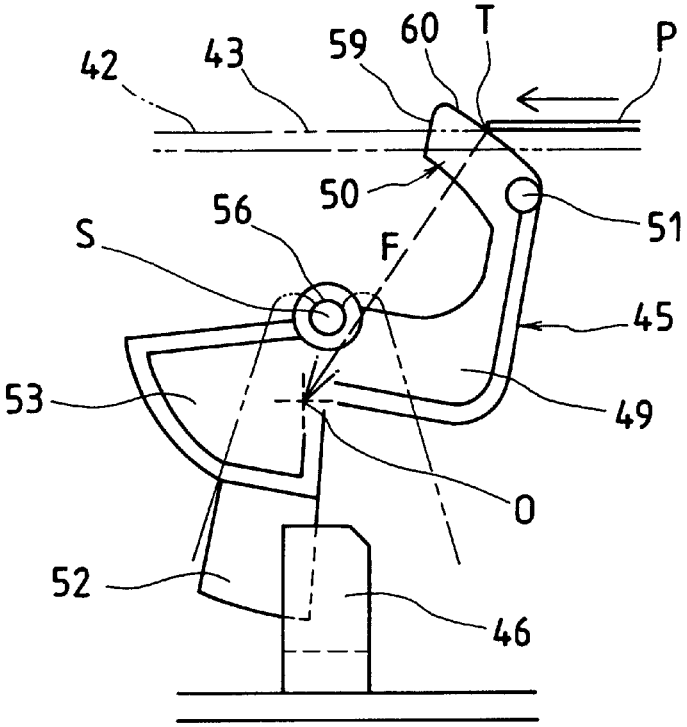
FIG. 12 is a view for illustrating the attitude of the detecting lever for the case where the sheet is delivered to the sheet detecting mechanism of FIG. 7 in the reverse direction.
Figure 13:
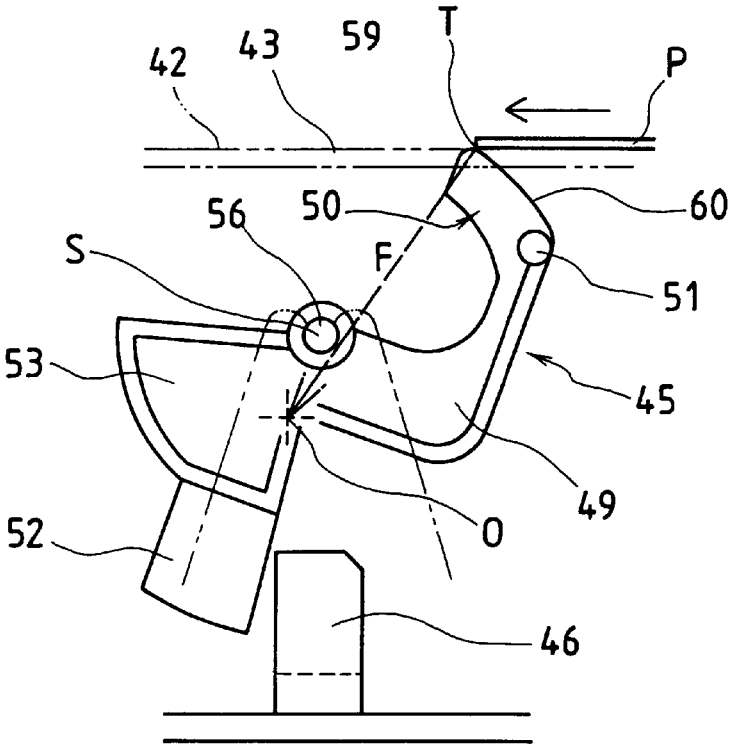
FIG. 13 is a view for illustrating the operation of the detecting lever for the case where the sheet is delivered to the sheet detecting mechanism of FIG. 7 in the reverse direction.

Referring now to FIGS. 11 to 13, there will be described the way the sheet detecting mechanism operates as it detects the leading end of the sheet P that is conveyed in the reverse direction.

When the leading end of the sheet P conveyed in the reverse direction (direction B) abuts against the arcuate portion 60 of the abutting portion 50, as shown in FIG. 11, friction between the respective engaging portions of the sheet P and the arcuate portion 60 initially produces a force to rock the detecting lever 45 counterclockwise. Since the stoppers 51 abut against the undersurface of the sheet guide plate 42 to restrict the detecting lever 45 to the initial position, however, this force is canceled inevitably. Further, the top surface of the leading end of the sheet P is softly pressed down by the print head 6 (see FIG. 1) on the carriage 5 that is moved to the center of the carriage shaft 3, lest the leading end of the sheet P lift above the top surface of the sheet guide plate 42. When the leading end of the sheet P then moves to the left of FIG. 11 along the arcuate portion 60 as the sheet P is conveyed in the reverse direction, the force of pressure from the sheet P presses the arcuate portion 60 toward the center point O.

This force of pressure (designated by F in FIG. 11) directed to the center point O of the arcuate portion 60 increases as the sheet P is conveyed in the reverse direction so that its leading end moves forward (or to the left of FIG. 11) in the moving direction. As shown in FIG. 11, a segment TO that connects the center point O of the arcuate portion 60 and an abutting point T between the leading end of the sheet P and the arcuate portion 60 is situated behind the rocking center point S of the detecting lever 45 with respect to the moving direction. Accordingly, the force of pressure directed to the center point O of the arcuate portion 60 acts as a moment to urge the detecting lever 45, whose arm covers the distance from the rocking center point S to the segment TO, to rock clockwise.

If the force of pressure directed to the center point O of the arcuate portion 60 increases so that it overcomes the urging force of the weight portion 53, therefore, the detecting lever 45 rocks in a direction such that the stoppers 51 recede from the undersurface of the sheet guide plate 42, that is, in the clockwise direction around the pivot 56 in FIG. 11, resisting the urging force of the weight portion 53 (see FIG. 12). As the detecting lever 45 rocks clockwise, the abutting portion 50 moves to the position under the conveyor path 43, and the sensor portion 52 moves in the direction to get out of the groove 46*a* of the sheet detecting sensor 46.

When the detecting lever 45 rocks clockwise to reach the detecting position shown in FIG. 13 as the sheet P is conveyed in the reverse direction, the abutting portion 50 completely submerges below the conveyor path 43, and the sensor portion 52 is entirely evacuated from the groove 46*a* of the sheet detecting sensor 46. Thereupon, the output signal of the sheet detecting sensor 46 is turned on, so that the sheet P is detected by the sheet detecting sensor 46.

When the leading end of the sheet P moves further in the reverse direction to pass the front end edge of the arcuate portion 60 (not shown), thereafter, the detecting lever 45 is stopped in the detecting position shown in FIG. 13, since the upper end edge of the vertical portion 59 is held down by the sheet P. When the trailing end of the sheet P passes the upper end edge of the vertical portion 59, the force of pressure on the upper end edge of the vertical portion 59 is removed, so that the detecting lever 45 is urged to rock in the counter-clockwise direction by the weight portion 53, and the stoppers 1 abut against the undersurface of the sheet guide plate 42 to be restrained thereby from rocking, whereupon the detecting lever 45 is kept stationary in the initial position of FIG. 7.

Figure 14:
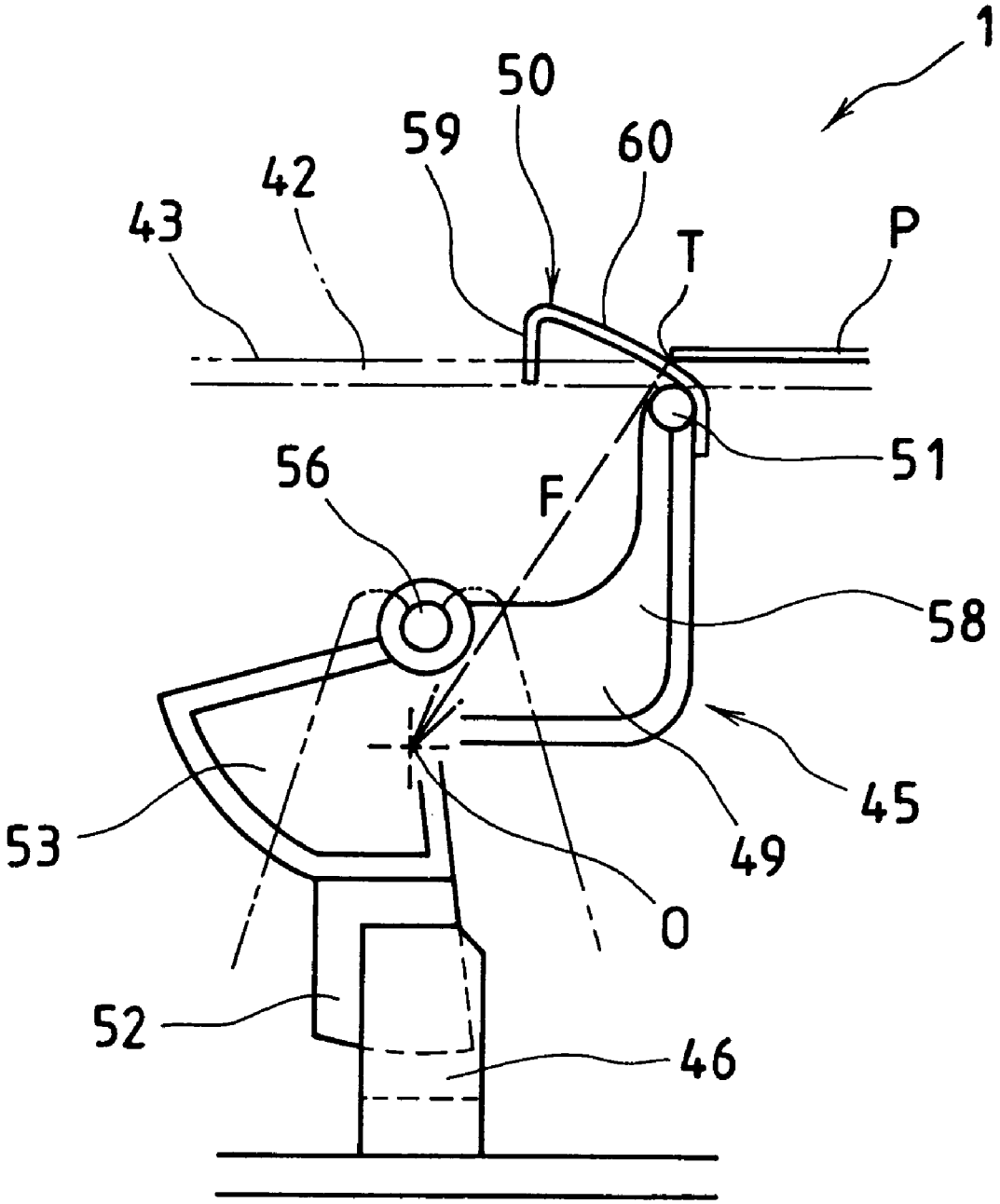
FIG. 14 is a side view showing another example of the sheet detecting mechanism according to the present invention.

Referring now to FIG. 14, there will be described an arrangement of another example of the sheet detecting mechanism.

A sheet detecting mechanism 41 shown in FIG. 14 is different only in that an abutting portion 50 of a detecting lever 45, unlike the abutting portion 50 shown in FIG. 7, is formed of a plate spring having a smooth surface, and other portions are common to the individual mechanisms.

When the sheet P abuts against the arcuate portion 60 of the abutting portion 50, thereby pressing the arcuate portion 60, the abutting portion 50, formed of an elastic material, bends, so that the force of pressure of the sheet P can be quickly converted into a force of pressure that is directed to the center of the circular arc. Thus, the sheet P can be detected with higher reliability.

As described above with reference to FIGS. 7 to 14, the sheet detecting mechanism 41 can be composed of one element part for sheet detection, and it is necessary only that the abutting portion 50 of the detecting lever 45 be located projecting above the conveyor path 43 for the sheet P. Thus, the detecting lever 45, sheet detecting sensor 46, and stoppers 51 can be arranged under the conveyor path 43 for the sheet P. In consequence, the transit substrates, signal harnesses, and connectors for connection can be reduced to ensure lower manufacturing costs, as compared to an arrangement in which isolated sensors are disposed on either side of a conveyor path.

According to this sheet detecting mechanism, when the sheet conveyed in one conveying direction (forward direction) abuts against the vertical portion of the abutting portion of the detecting lever, the sheet presses the vertical portion, thereby causing the detecting lever to rock from the initial position to the detecting position, whereupon the leading end of the sheet can be detected by means of the sensor. When the sheet conveyed in the other conveying direction (reverse direction) abuts against the arcuate portion, the sheet presses the arcuate portion, thereby causing the detecting lever to rock from the initial position to the detecting position, whereupon the sheet can be detected by means of the sensor. Accordingly, the mechanism can be composed of one element part for detection, and it is necessary only that the abutting portion of the detecting lever be located projecting above the sheet conveyor path. Thus, the detecting lever, sensor, and stoppers can be arranged on one side in a direction perpendicular to the under the sheet conveyor path. In consequence, the transit substrates, signal harnesses, and connectors for connection can be reduced to ensure lower manufacturing costs, as compared to the arrangement in which the isolated sensors are disposed on either side of the conveyor path.

Since the detecting lever is restricted to the initial position by the urging means and the stoppers when the sheet is not in contact with the abutting portion of the detecting lever, moreover, the abutting portion can be accurately returned to its regular position.

In the sheet conveyor path of the printer in which the sheet can be conveyed in both forward and reverse directions, moreover, the presence of the sheet can be detected by means of the detecting lever having a simple construction, so that the sensor can be composed of one element part for detection, such as a transmission-type photo-interrupter. Furthermore, the abutting portion of the detecting lever is located projecting above the sheet conveyor path so that the detecting lever, sensor, and stoppers can be arranged under the sheet conveyor path. As compared to the arrangement in which the isolated sensors are disposed on either side of the conveyor path, therefore, the transit substrates, signal harnesses, and connectors for connection can be reduced to ensure lower manufacturing costs.

Since the sensor is located directly on the main control board that is attached to the printer, moreover, a compact design can be obtained with ease. If the sheet abuts against the abutting portion to press the arcuate portion, the abutting portion bends, so that the detecting lever can be easily rocked from the initial position to the detecting position. Thus, the sheet can be detected with higher reliability.

What is claimed is:

1. A printer, comprising:

a carriage shaft;

a carriage slidably supported on said carriage shaft so as to be able to reciprocate along the carriage shaft in a direction perpendicular to a sheet feeding direction;

a print head mounted on said carriage;

a platen arranged so as to oppose said print head;

a conveyor plate forming a sheet conveyor path; and a sheet guide provided on at least one of opposite sides of said print head in the sheet feeding direction, wherein said sheet guide has an edge which recedes in each side thereof relative to the central portion thereof, in the advancing direction of the sheet.

2. A printer according to claim 1, wherein said sheet guide has an arcuate end edge opposite to said print head, the width-direction central portion of the end edge being located at the longest distance from the print head so that the space between the end edge and the print head gradually increases with lateral distance from the width-direction central portion of said end edge.

3. A printer according to claim 2, wherein said end edge of said sheet guide opposite to the print head is adjoined by a sheet guide face for guiding the sheet moving in said sheet conveyor path to a region under said sheet guide.

4. A printer according to claim 2, wherein said sheet guide has a structure divided into two parts, left and right, in the center, each of the left- and right-hand divided sheet guides being provided with a roller pivot, said roller pivot being fitted with a plurality of pressure-contact rollers for rotation.

5. A printer according to claim 1, further comprising:

left and right frames;

a rocking frame;

a guide pivot portion attached to said rocking frame; and a rocking frame pivot stretched between said left and right frames, wherein said rocking frame is rockably mounted on said rocking frame pivot, and said sheet guide is rockably mounted on said guide pivot portion.

6. A printer according to claim 1, wherein said print head moves to a substantially central portion of said sheet conveyor path before the leading end portion of the sheet is guided by said sheet guide during sheet feed.

7. A printer according to claim 1, wherein said sheet guide is located on each side of the print head.

8. A printer according to claim 7, further comprising a switching plate for changing the course of cut sheets or a continuous sheet and a tractor for feeding the continuous sheet, arranged on the side, opposite to the print head, of said one sheet guide.

9. A printer according to claim 1, wherein said sheet conveyor path is substantially rectilinear.

10. A printer according to claim 7, wherein said sheet can be fed in either of two opposite directions, forward and reverse.

11. A printer according to claim 1, further comprising a sheet feed roller for feeding the sheet, wherein said sheet guide is provided with a rotatable pressure-contact roller for pressing the sheet against the sheet feed roller.

12. A printer according to claim 1, wherein said sheet guide is composed of a plurality of members.

13. A printer according to claim 1, further comprising a sheet detecting mechanism for detecting the presence of the sheet, wherein the mechanism is on said sheet conveyor path.

14. A printer according to claim 13, wherein said sheet detecting mechanism includes a detecting lever rockable in a sheet conveying direction and a sensor for detecting the position of the detecting lever, one end of said detecting lever having thereon an abutting portion adapted to abut against the sheet on the sheet conveyor path, the other end having thereon a sensor portion for switching said sensor, one side of said abutting portion in the sheet conveying direction having a vertical portion perpendicular to the sheet conveying direction, and the other axis having an arcuate portion.

15. A printer according to claim 13, wherein said sheet detecting mechanism further includes urging means for urging said detecting lever toward the side on which said vertical portion is formed and a stopper for keeping said vertical portion vertical, resisting the urging force of the urging means.

16. A printer according to claim 14, further comprising a main control board, wherein said sensor is located on said main control board.

17. A printer according to claim 11, wherein said abutting portion of said detecting lever is formed of a spring member.

18. A printer according to claim 1, wherein said sheet is a bankbook.

* * * * *